US008550018B2

(12) United States Patent
Lin

(10) Patent No.: US 8,550,018 B2
(45) Date of Patent: Oct. 8, 2013

(54) STIRRING CONTROL METHOD AND STIRRING CONTROL DEVICE FOR A COMBUSTION APPARATUS

(75) Inventor: Jung-Lang Lin, Taichung (TW)

(73) Assignee: Suncue Company Ltd., Taichung (TW)

( * ) Notice: Subject to any disclaimer, the term of this patent is extended or adjusted under 35 U.S.C. 154(b) by 170 days.

(21) Appl. No.: 13/301,060

(22) Filed: Nov. 21, 2011

(65) Prior Publication Data

US 2012/0247377 A1 Oct. 4, 2012

(30) Foreign Application Priority Data

Apr. 1, 2011 (TW) ..... 100111582

(51) Int. Cl.
*F23G 5/28* (2006.01)

(52) U.S. Cl.
USPC ..... 110/346; 110/347; 110/258; 110/185; 110/275; 110/247; 110/341; 110/233; 48/197; 374/141; 374/142

(58) Field of Classification Search
USPC ..... 110/346, 258, 185, 191, 247, 275
See application file for complete search history.

(56) References Cited

U.S. PATENT DOCUMENTS 1,412,921 A * 4/1922 Chapman ..... 48/85.2
2,118,651 A * 5/1938 Macchi ..... 250/222.1
2,147,324 A * 2/1939 Ackeren ..... 110/229
3,411,465 A * 11/1968 Takashi ..... 110/227
3,671,167 A * 6/1972 Nakano ..... 431/190
4,043,280 A * 8/1977 Wray et al. ..... 110/238
4,313,387 A * 2/1982 Sato ..... 110/192
4,453,949 A * 6/1984 Fasching et al. ..... 48/77
4,484,531 A * 11/1984 Firey ..... 110/342
4,583,992 A * 4/1986 Rogers ..... 48/76
4,615,713 A * 10/1986 Meyer ..... 48/77
4,646,637 A * 3/1987 Cloots ..... 110/245
4,655,146 A * 4/1987 Lemelson ..... 110/346
4,659,340 A * 4/1987 Weaver ..... 48/76
5,081,940 A * 1/1992 Motomura et al. ..... 110/346
5,094,669 A * 3/1992 Herbert et al. ..... 48/197 R
5,159,884 A * 11/1992 Malick ..... 110/223
5,226,927 A * 7/1993 Rundstrom ..... 48/76
5,230,716 A * 7/1993 Notestein ..... 48/62 R
5,628,261 A * 5/1997 Beckstead et al. ..... 110/346
5,799,590 A * 9/1998 Noguchi ..... 110/216
6,619,216 B2 * 9/2003 Lin ..... 110/233
7,393,206 B2 7/2008 Lin
7,422,429 B2 9/2008 Lin
7,621,227 B2 * 11/2009 Sterr ..... 110/297
7,964,026 B2 * 6/2011 Rogers ..... 95/187
8,105,401 B2 * 1/2012 Neves et al. ..... 48/197 R (Continued)

*Primary Examiner* — Kenneth Rinehart
*Assistant Examiner* — Sharla Magana
(74) *Attorney, Agent, or Firm* — Holland & Hart, LLP

(57) ABSTRACT

A stirring control method is adapted for a combustion apparatus which includes a furnace for burning fuel material, and a stirring member rotatably disposed in the furnace for stirring the fuel material and ash resulting from burning of the fuel material. The stirring control method includes: controlling rotation of the stirring member at an initial rotational speed; determining whether a height of the fuel material reaches an upper detection range; generating an indication when the height of the fuel material reaches the upper detection range; determining whether the height of the fuel material reaches a lower detection range when the height of the fuel material does not reach the upper detection range; and controlling rotation of the stirring member at a rotational speed higher than the initial rotational speed when the height of the fuel material reaches the lower detection range.

10 Claims, 3 Drawing Sheets

(56) References Cited

U.S. PATENT DOCUMENTS

| | | | | |
|---|---|---|---|---|
| 8,216,345 | B2 * | 7/2012 | Rogers et al. | 95/187 |
| 2005/0268556 | A1 * | 12/2005 | Rogers | 48/197 FM |
| 2007/0137538 | A1 * | 6/2007 | Sterr | 110/341 |
| 2009/0056694 | A1 * | 3/2009 | Lin | 126/244 |
| 2010/0058960 | A1 * | 3/2010 | Raley et al. | 110/185 |
| 2010/0132258 | A1 * | 6/2010 | Linck et al. | 48/197 FM |
| 2011/0137444 | A1 * | 6/2011 | Runkana et al. | 700/103 |

* cited by examiner

STIRRING CONTROL METHOD AND STIRRING CONTROL DEVICE FOR A COMBUSTION APPARATUS

BACKGROUND OF THE INVENTION

1. Field of the Invention

The present invention relates to a control method and a control device, more particularly to a stirring control method and a stirring control device for a combustion apparatus which burns fuel material to generate heat energy.

2. Description of the Related Art

In general, a raw material may be burned to generate usable heat energy even if the raw material such as hull and shell waste of agricultural crops is inedible. Heat exchange furnaces disclosed in U.S. Pat. Nos. 7,422,429 and 7, 393, 206 may generate usable heat energy by means of burning the raw material, so as to achieve effects of resource recycling and energy reuse.

A great amount of dust and ash, and high temperature fumes not less than about one thousand degrees centigrade are generated as a result of burning the raw material. Therefore, in order to prevent ash from blocking the aforesaid furnace and adversely affecting combustion efficiency of the raw material, currently, a stirring device is adopted for stirring a lower part of the raw material and the ash generated from burning the raw material so as to promote the combustion efficiency and facilitate discharge of the ash.

The high temperature fumes in the furnace may damage the aforesaid stirring device. Nevertheless, the stack of raw material may form a barrier separating a burning space above the raw material and an ash discharge space below the raw material, thus protecting the aforesaid stirring device in the ash discharge space. However, since an amount of the raw material for burning varies with respect to different heat energy requirements of the furnace, a height of the raw material is usually insufficient for achieving an effect of separating the high temperature fumes, so that the aforesaid stirring device is still prone to damage and has a disadvantage of short service life.

SUMMARY OF THE INVENTION

Therefore, an object of the present invention is to provide a stirring control method and a stirring control device for a combustion apparatus. The stirring control method and the stirring control device are capable of promoting service life of components in the combustion apparatus.

In one aspect of the present invention, the stirring control method for a combustion apparatus utilizes a stirring control device. The combustion apparatus includes a furnace for burning fuel material, and a stirring member rotatably disposed in the furnace for stirring the fuel material in the furnace and ash resulting from burning of the fuel material in the furnace. The stirring control method comprises:

(A) configuring the stirring control device to control rotation of the stirring member at an initial rotational speed;

(B) configuring the stirring control device to determine whether a height of the fuel material in the furnace reaches an upper detection range;

(C) configuring the stirring control device to generate a first indication when the height of the fuel material in the furnace reaches the upper detection range;

(D) configuring the stirring control device to determine whether the height of the fuel material in the furnace reaches a lower detection range when the height of the fuel material in the furnace does not reach the upper detection range; and (E) configuring the stirring control device to control rotation of the stirring member at a first rotational speed higher than the initial rotational speed when the height of the fuel material in the furnace reaches the lower detection range.

In another aspect of the present invention, a stirring control device is for use with a combustion apparatus. The combustion apparatus includes a furnace for burning fuel material, and a stirring member rotatably disposed in the furnace for stirring the fuel material in the furnace and ash resulting from burning of the fuel material in the furnace. The stirring control device comprises an upper detector, a lower detector and a control module. The upper detector is to be disposed on the furnace for determining whether a height of the fuel material in the furnace reaches an upper detection range. The lower detector is to be disposed on the furnace for determining whether the height of the fuel material in the furnace reaches a lower detection range lower than the upper detection range. The control module is associated operably with the upper and lower detectors. The control module is configured to control generation of a first indication when the height of the fuel material in the furnace reaches the upper detection range, and to control rotation of the stirring member at a first rotational speed higher than an initial rotational speed when the height of the fuel material in the furnace reaches the lower detection range and does not reach the upper detection range.

The effect of the present invention resides in intelligently deciding rotational speed of the stirring member, and maintaining the height of the fuel material in the furnace to be within an appropriate range. In this way, the fuel material with the appropriate height may effectively separate the burning space above the fuel material and the ash discharge space below the fuel material, so as to promote the service life of the relevant components disposed in the ash discharge space.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
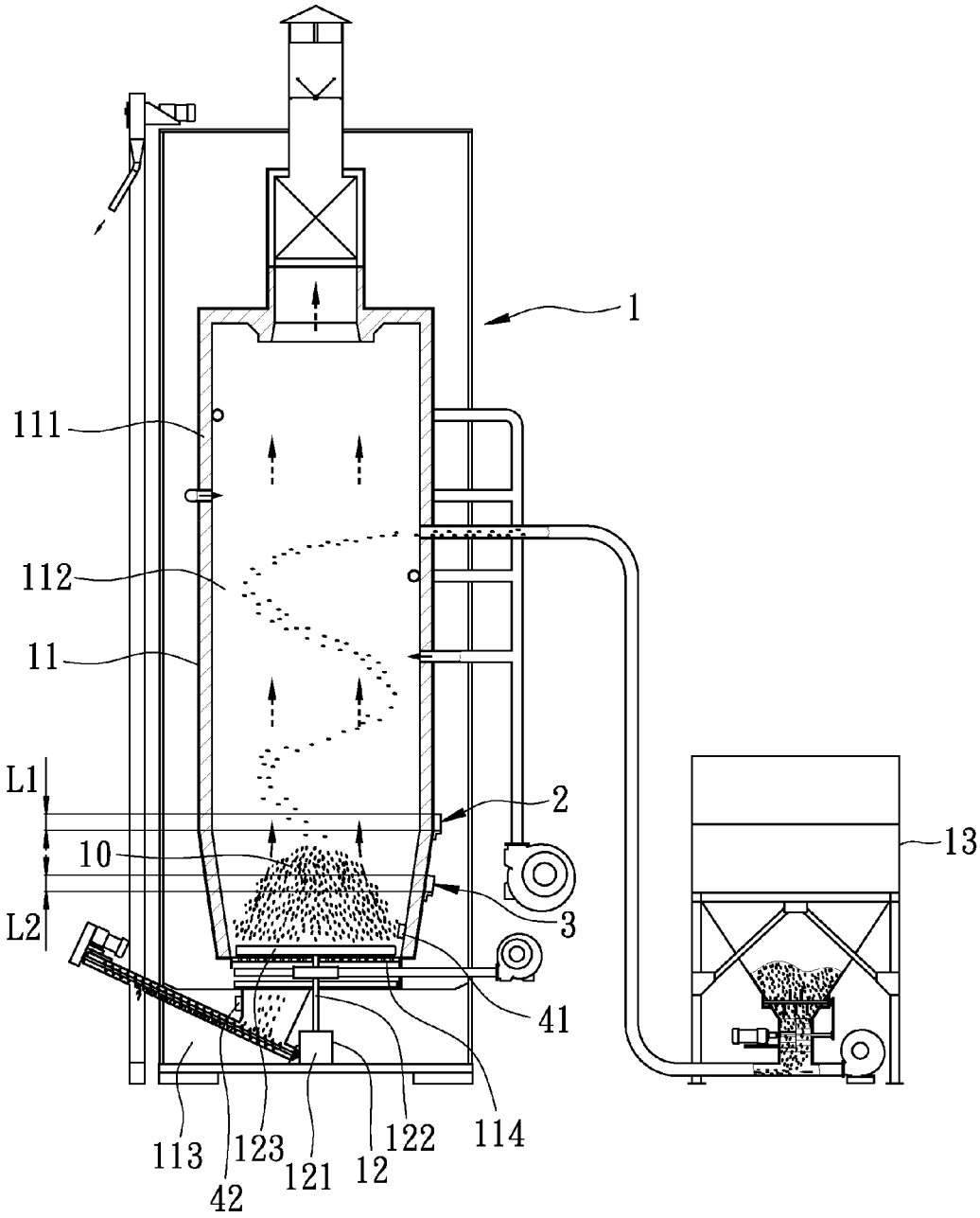
FIG. 1 is a schematic diagram illustrating a preferred embodiment of a stirring control method and a stirring control device for a combustion apparatus according to the present invention.
Figure 2:
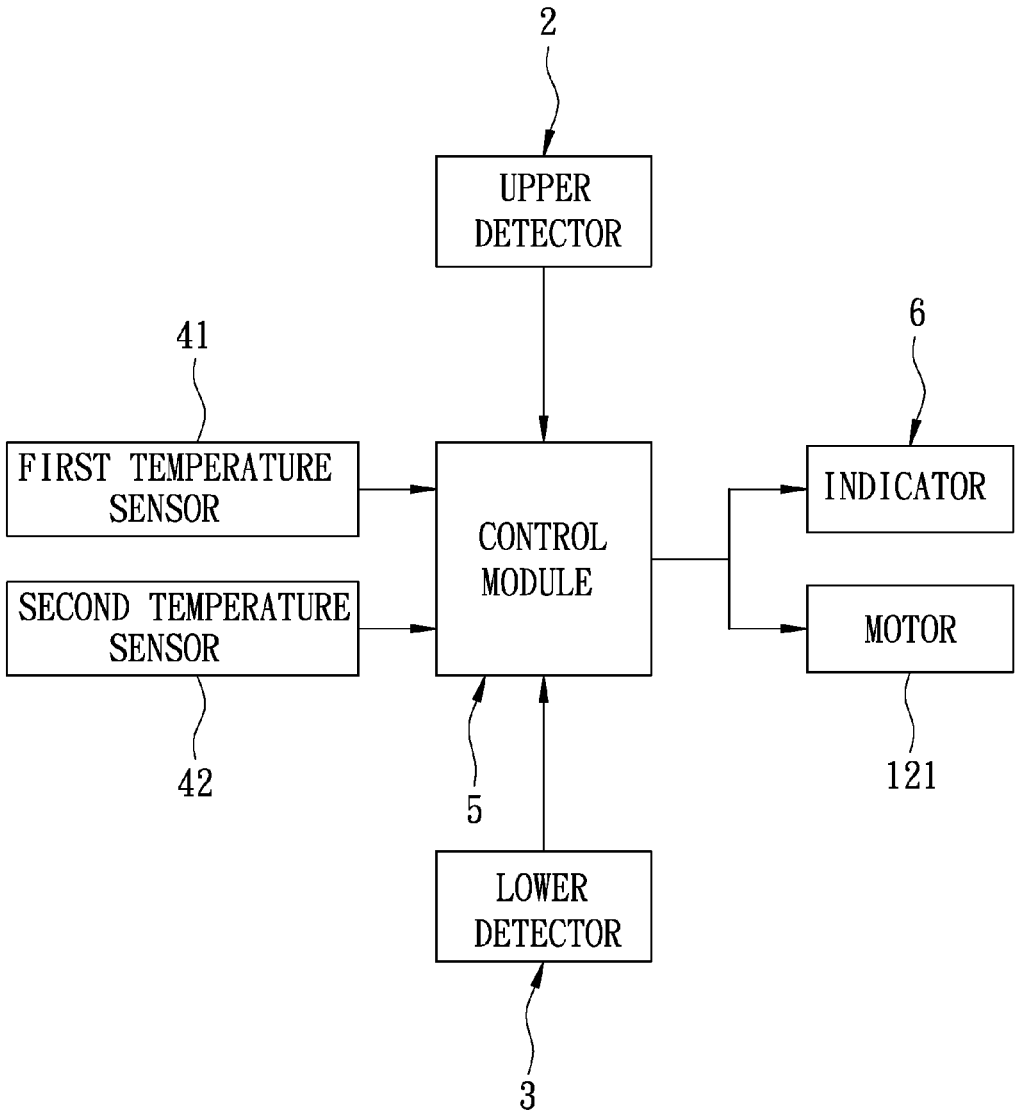
FIG. 2 is a block diagram of the preferred embodiment.

Referring to FIG. 1 and FIG. 2, a preferred embodiment of a stirring control device for a combustion apparatus 1, according to the present invention, is illustrated. The combustion apparatus 1 includes a furnace 11 for burning fuel material 10 to generate heat energy, a stirring device 12, and a material feeder 13 for feeding the fuel material 10 into the furnace 11. The furnace 11 has a furnace housing 111, and includes a tray 114 mounted on an inner wall of the furnace housing 111, so as to form a burning space 112 in the furnace 11 and an ash discharge space 113 below the burning space 112. The tray 114 is adapted for supporting the fuel material 10 thereon, and is formed with a plurality of apertures for passage of ash resulting from burning of the fuel material 10 in the furnace 11 through the tray 114 into the ash discharge space 113. The stirring device 12 includes a motor 121 disposed below the furnace 11, a shaft 122 driven by the motor 121 and extending through the tray 114, and a stirring member 123 mounted to the shaft 122 and disposed on the tray 114 for stirring the fuel material 10 in the furnace 11 and the ash resulting from burning of the fuel material 10 in the furnace 11. In the preferred embodiment, the stirring member 123 is a stirring rod.

The stirring control device comprises an upper detector 2, a lower detector 3, a first temperature sensor 41, a second temperature sensor 42, a control module 5, and an indicator 6.

The upper detector 2 is to be disposed on the furnace 11 for determining whether a height of the fuel material 10 in the furnace 11 reaches an upper detection range L1. In the preferred embodiment, the upper detector 2 is a photodetector.

The lower detector 3 is to be disposed on the furnace for determining whether the height of the fuel material 10 in the furnace 11 reaches a lower detection range L2 lower than the upper detection range L1. In the preferred embodiment, the lower detector 3 is also a photodetector.

The first temperature sensor 41 is to be disposed in the furnace 11, and is adapted for detecting a burning temperature of a lower part of the fuel material 10 in the furnace 11.

The second temperature sensor 42 is to be disposed in the ash discharge space 113 on the furnace 11, and is adapted for detecting temperature of the ash, which results from burning of the fuel material 10 in the furnace 11, in the ash discharge space 113.

The control module 5 is associated operably with the upper detector 2, the lower detector 3, the first temperature sensor 41 and the second temperature sensor 42. The control module 5 is electrically coupled to the motor 121 for controlling rotational speed of the stirring member 123, and stores a preset burning temperature and a preset ash temperature.

The indicator 6 is controlled by the control module 5 for generating a first indication and a second indication. In the preferred embodiment, the first and second indications are independently selected from at least one of an audible indication, a light indication and a text indication.

Figure 3:
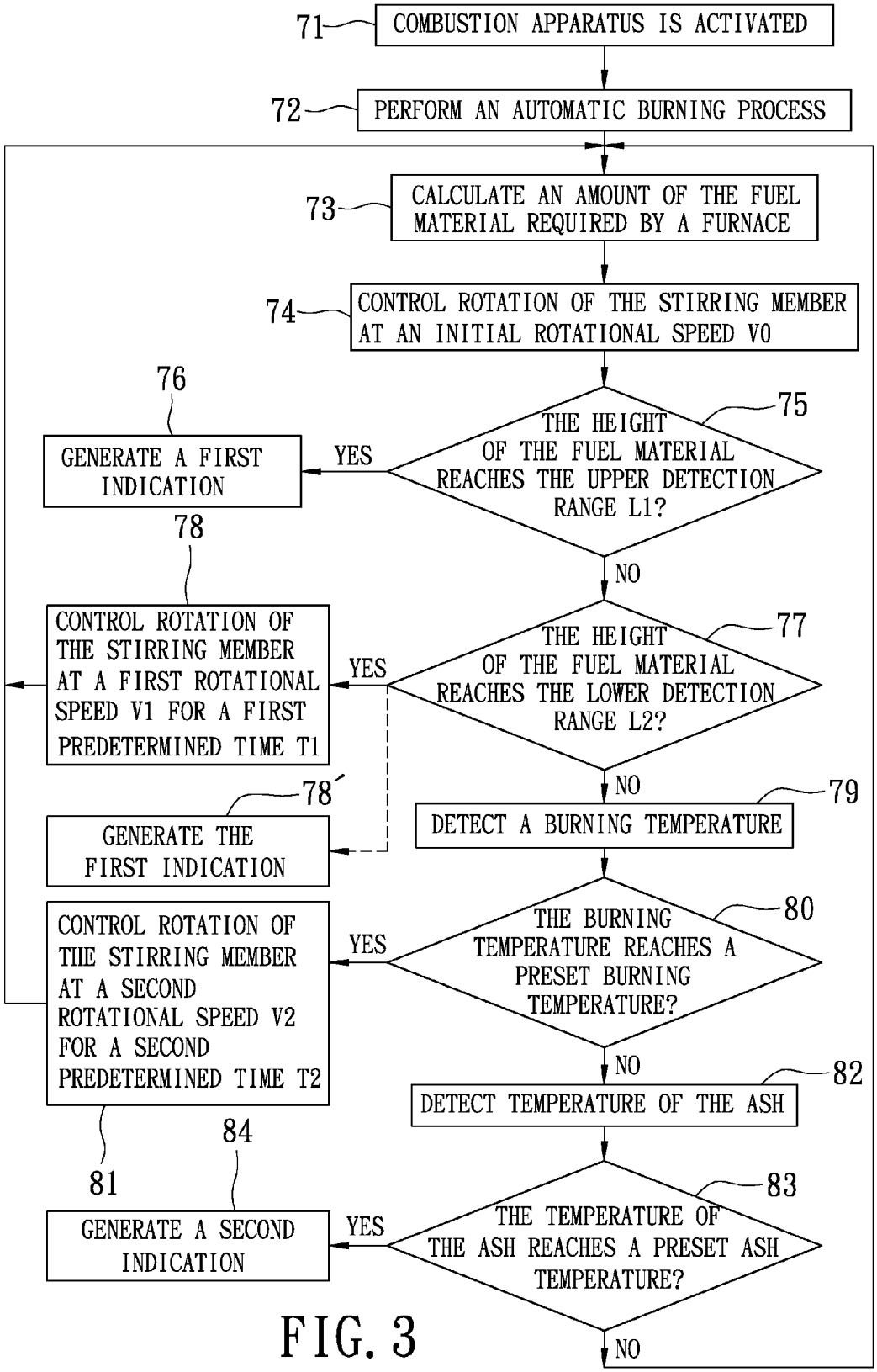
FIG. 3 is a flow chart of the preferred embodiment.

Referring to FIG. 1 to FIG. 3, an operational flow of the preferred embodiment of a stirring control method for a combustion apparatus 1, according to the present invention, is described hereinafter:

In step 71, the combustion apparatus 1 is activated.

In step 72, the combustion apparatus 1 is configured to perform an automatic burning process.

In step 73, the control module 5 is configured to calculate an amount of the fuel material 10 required by the furnace 11 during the automatic burning process according to heat energy demand.

In step 74, the control module 5 is configured to control rotation of the stirring member 123 at an initial rotational speed $V_0$ via the motor 121.

In step 75, the upper detector 2 is configured to make a first determination as to whether the height of the fuel material 10 piled on the tray 114 in the furnace 11 reaches the upper detection range L1.

In step 76, when a result of the first determination made in step 75 is affirmative, it means that the height of the fuel material 10 in the furnace 11 has exceeded an alert limit, i.e., flame in the furnace 11 has been extinguished such that the fuel material 10 may no longer be burned. At this time, the control module 5 is configured to control the indicator 6 to generate the first indication, and to control the combustion apparatus 1 to stop the automatic burning process.

In step 77, when the result of the first determination made in step 75 is negative, it means that the height of the fuel material 10 in the furnace 11 does not reach the alert limit, and the lower detector 3 is configured to make a second determination as to whether the height of the fuel material 10 in the furnace 11 reaches the lower detection range L2.

In step 78, when a result of the second determination made in step 77 is affirmative, it means that the height of the fuel material 10 in the furnace 11 is sufficiently high, and the control module 5 is configured to control rotation of the stirring member 123 at a first rotational speed $V_1$ higher than the initial rotational speed $V_0$ for a first predetermined time $t_1$, and the flow goes back to step 73. By means of increasing rotational speed of the stirring member 123, a time required to make the ash resulting from burning of the fuel material 10 in the furnace 11 fall into the ash discharge space 113 is shortened, and the fuel material 10 in the furnace 11 is stirred with increasing frequency, such that combustion efficiency of the fuel material 10 in the furnace 11 is promoted.

It should be noted that when the lower detector 3 determines that the height of the fuel material 10 piled on the tray 114 in the furnace 11 still reaches the lower detection range L2 after step 78 has been repeated for a predetermined number of times, it means that the height of the fuel material 10 in the furnace 11 is not reduced in spite of increasing rotational speed of the stirring member 123, and there might be a malfunction of the stirring member 123. Subsequently, step 78' is performed.

In step 78', the control module 5 is configured to control the indicator 6 to generate the first indication which is selected from at least one of the audible indication, the light indication and the text indication.

In step 79, when the result of the second determination made in step 77 is negative, the first temperature sensor 41 is configured to detect the burning temperature of the lower part of the fuel material 10 in the furnace 11, and to transmit the burning temperature back to the control module 5.

In step 80, the control module 5 is configured to make a third determination as to whether the burning temperature of the fuel material 10 in the furnace 11 reaches the preset burning temperature.

In step 81, when a result of the third determination made in step 80 is affirmative, it means that the burning temperature of the lower part of the fuel material 10 in the furnace 11 is too high, and the control module 5 is configured to control rotation of the stirring member 123 at a second rotational speed $V_2$ lower than the initial rotational speed $V_0$ for a second predetermined time $t_2$ via the motor 121, and the flow goes back to step 73.

In step 82, when the result of the third determination made in step 80 is negative, the second temperature sensor 42 is configured to detect the temperature of the ash, which results from burning of the fuel material 10 in the furnace 11, in the ash discharge space 113, and to transmit the temperature of the ash back to the control module 5.

In step 83, the control module 5 is configured to make a fourth determination as to whether the temperature of the ash, which results from burning of the fuel material 10 in the furnace 11, in the ash discharge space 113 reaches the preset ash temperature.

In step 84, when a result of the fourth determination made in step 83 is affirmative, it means that the temperature of the ash, which results from burning of the fuel material 10 in the furnace 11, in the ash discharge space 113 is too high probably because the amount of the fuel material 10 in the furnace 11 is insufficient such that a great amount of the ash and the burning fuel material 10 passes through the tray 114 and falls into the ash discharge space 113. At this time, the control module 5 is configured to control the indicator 6 to generate the second indication which is selected from at least one of the audible indication, the light indication and the text indication.

When the result of the fourth determination made in step 83 is negative, the flow goes back to step 73.

In this way, the height of the fuel material 10 in the furnace 11 may be maintained so as to effectively separate the burning space 112 above the fuel material 10 and the ash discharge space 113 below the fuel material 10 such that the stirring device 12 may be prevented from damage resulting from high temperature fumes.

It is apparent from the foregoing that the stirring control method and the stirring control device for a combustion apparatus, according to the present invention, have the following benefits and effects:

This invention is capable of intelligently controlling rotational speed of the stirring member 123 and maintaining the height of the fuel material 10 in the furnace 11 within a preferred range such that the fuel material 10 in the furnace 11 with an appropriate height may effectively separate the burning space 112 above the fuel material 10 and the ash discharge space 113 below the fuel material 10. Therefore, the stirring device 12 may be prevented from damage resulting from the high temperature fumes so as to promote service life of components in the ash discharge space 113.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A stirring control method for a combustion apparatus, the combustion apparatus including a furnace for burning fuel material, and a stirring member rotatably disposed in the furnace for stirring the fuel material in the furnace and ash resulting from burning of the fuel material in the furnace, the stirring control method utilizing a stirring control device and comprising:

(A) configuring the stirring control device to control rotation of the stirring member at an initial rotational speed;

(B) configuring the stirring control device to determine whether a height of the fuel material in the furnace reaches an upper detection range;

(C) configuring the stirring control device to generate a first indication when the height of the fuel material in the furnace reaches the upper detection range;

(D) configuring the stirring control device to determine whether the height of the fuel material in the furnace reaches a lower detection range when the height of the fuel material in the furnace does not reach the upper detection range; and (E) configuring the stirring control device to control rotation of the stirring member at a first rotational speed higher than the initial rotational speed when the height of the fuel material in the furnace reaches the lower detection range.

2. The stirring control method as claimed in claim 1, further comprising:

(F) configuring the stirring control device to determine whether a burning temperature of the fuel material in the furnace reaches a preset burning temperature; and (G) configuring the stirring control device to control rotation of the stirring member at a second rotational speed lower than the initial rotational speed when the burning temperature of the fuel material in the furnace reaches the preset burning temperature.

3. The stirring control method as claimed in claim 2, further comprising:

(H) configuring the stirring control device to determine whether temperature of the ash resulting from burning of the fuel material in the furnace reaches a preset ash temperature when the burning temperature of the fuel material in the furnace does not reach the preset burning temperature; and (I) configuring the stirring control device to generate a second indication when the temperature of the ash reaches the preset ash temperature.

4. The stirring control method as claimed in claim 2, wherein the stirring control device is configured to repeat steps (A) to (G) each time the stirring member has rotated at either one of the first and second rotational speeds for a respective predetermined time.

5. The stirring control method as claimed in claim 4, wherein the stirring control device is configured to generate the first indication when the stirring control device determines that the height of the fuel material in the furnace still reaches the lower detection range after step (E) has been repeated for a predetermined number of times.

6. A stirring control device for a combustion apparatus, the combustion apparatus including a furnace for burning fuel material, and a stirring member rotatably disposed in the furnace for stirring the fuel material in the furnace and ash resulting from burning of the fuel material in the furnace, said stirring control device comprising:

an upper detector to be disposed on the furnace for determining whether a height of the fuel material in the furnace reaches an upper detection range;

a lower detector to be disposed on the furnace for determining whether the height of the fuel material in the furnace reaches a lower detection range lower than the upper detection range; and a control module associated operably with said upper and lower detectors;

wherein said control module is configured to control generation of a first indication when the height of the fuel material in the furnace reaches the upper detection range, and to control rotation of the stirring member at a first rotational speed higher than an initial rotational speed when the height of the fuel material in the furnace reaches the lower detection range and does not reach the upper detection range.

7. The stirring control device as claimed in claim 6, further comprising an indicator controlled by said control module for generating the first indication.

8. The stirring control device as claimed in claim 6, further comprising a first temperature sensor to be disposed on the furnace and associated operably with said control module, said first temperature sensor detecting a burning temperature of the fuel material in the furnace, said control module being configured to control rotation of the stirring member at a second rotational speed lower than the initial rotational speed when the burning temperature of the fuel material in the furnace reaches a preset burning temperature.

9. The stirring control device as claimed in claim 6, further comprising a second temperature sensor to be disposed on the furnace and associated operably with said control module, said second temperature sensor detecting temperature of the ash resulting from burning of the fuel material in the furnace, said control module being configured to control generation of a second indication when the temperature of the ash reaches a preset ash temperature.

10. The stirring control device as claimed in claim 9, further comprising an indicator controlled by said control module for generating the first and second indications.

* * * * *